US006524494B2

(12) United States Patent
Hart et al.

(10) Patent No.: US 6,524,494 B2
(45) Date of Patent: Feb. 25, 2003

(54) COMPOSITIONS TO ENHANCE FABRIC FRESHNESS AND APPEARANCE

(75) Inventors: Gerald Leslie Hart, deceased, late of Surbiton (GB), by Susan Hart, executrix; Thomas McGee, Nanuet, NY (US); Guy Edward Naish, Bicester (GB)

(73) Assignee: Givaudan SA, Geneva (CH)

( * ) Notice: Subject to any disclaimer, the term of this patent is extended or adjusted under 35 U.S.C. 154(b) by 0 days.

(21) Appl. No.: 09/776,557

(22) Filed: Feb. 2, 2001

(65) Prior Publication Data

US 2002/0148994 A1 Oct. 17, 2002

(51) Int. Cl.[7] ..... D06M 15/647; D06M 13/00; C11D 3/37; C11D 3/50

(52) U.S. Cl. ..... 252/8.91; 252/8.61; 252/8.62; 252/8.63; 38/144; 427/393.2

(58) Field of Search ..... 252/8.61, 8.91, 252/8.62, 8.63; 38/144; 427/393.2

(56) References Cited

U.S. PATENT DOCUMENTS

| | | | | |
|---|---|---|---|---|
| 3,674,688 A | | 7/1972 | Schwartz et al. | 252/8.91 |
| 3,833,393 A | | 9/1974 | Kandathil | 106/215.5 |
| 4,661,268 A | | 4/1987 | Jacobson et al. | 252/8.91 |
| 4,806,254 A | | 2/1989 | Church | 252/8.91 |
| 4,923,623 A | | 5/1990 | Coffindaffer | 252/8.91 |
| 5,100,566 A | | 3/1992 | Agbomeirele et al. | 252/8.91 |
| 5,532,023 A | | 7/1996 | Vogel et al. | 427/8 |
| 5,573,695 A | * | 11/1996 | Targosz | 252/8.91 |
| 5,798,107 A | | 8/1998 | Vogel et al. | 424/400 |
| 5,968,404 A | * | 10/1999 | Trinh et al. | 106/205.01 |
| 6,001,343 A | | 12/1999 | Trinh et al. | 424/76.4 |
| 6,123,950 A | * | 9/2000 | Hughes | 134/42 |

FOREIGN PATENT DOCUMENTS

| | | | |
|---|---|---|---|
| EP | 0 228 261 A2 | | 7/1987 |
| EP | 1 201 816 A1 | | 5/2002 |
| JP | 10046471 | | 2/1998 |
| WO | WO 96/19119 | | 6/1996 |
| WO | WO 00/24857 | | 5/2000 |
| WO | WO 01 31114 A1 | | 5/2001 |
| WO | 01/48302 | * | 7/2001 |

OTHER PUBLICATIONS

Copy of International Search Report mailed 08/022002 of International Application No. PCT/CH02/00053, filed Jan. 31, 2002.

* cited by examiner

*Primary Examiner*—Anthony J. Green
(74) *Attorney, Agent, or Firm*—Andrew N. Parfomak; Norris, McLaughlin & Marcus

(57) ABSTRACT

A fabric refreshing composition is disclosed, which provides long-lasting fragrance retention, malodor reduction, and wrinkle abatement. This composition includes a water soluble silicone of the formula I:

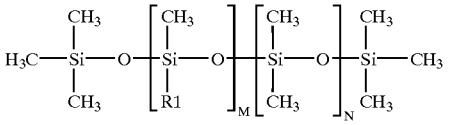

wherein

M is 40 to 200,

N is 0 to 20, and

R1 is a polyethylene or a polypropylene ether; a fragrance composition; and an aqueous carrier comprising an emulsifier. Processes for refreshing fabrics using such compositions are also provided.

31 Claims, No Drawings

COMPOSITIONS TO ENHANCE FABRIC FRESHNESS AND APPEARANCE

FIELD OF THE INVENTION

The present invention relates to a composition for refreshing a fabric. More particularly, the present invention relates to an aqueous composition that provides long-lasting fragrance, malodor control, and imparts improved appearance to fabrics treated with such a composition.

BACKGROUND OF THE INVENTION

There is an increasing use of more informal clothes for both business as well as leisure. Often these types of clothes are re-used without laundering, or when laundered are not ironed. The high cost and environmental considerations of traditional dry-cleaning reduces the desirability of such a process to "freshen" clothes. Accordingly, there is a need for compositions and processes that may be used by a consumer to provide clothes with a reduced malodor, a fresh long-lasting scent, and an attractive appearance (i.e., reduced wrinkles and creases) without resort to conventional laundering and ironing or dry cleaning.

Compositions have been developed that are sprayed onto fabrics to improve their appearance. For example, Schwartz et al., U.S. Pat. No. 3,674,688 discloses an aqueous alcoholic solution of a cationic surfactant, such as dialkyl dimethyl ammonium chloride, to remove wrinkles. Kandathil, U.S. Pat. No. 3,833,393 discloses a composition containing a fabric stiffening agent, such as starch, an organic solvent with high penetrating ability and an emulsifiable wax, with optional ingredients such as a water-soluble polyalkylene glycol, a salt of a water-soluble amine, and a fatty acid or an emulsified silicone that may be sprayed onto a fabric to stiffen it.

Jacobson et al., U.S. Pat. No. 4,661,268 discloses a product and a process for removing wrinkles. The product consists essentially of an alcohol-aqueous solution containing a silicone-glycol copolymer surfactant and/or a fluorinated alkyl ester surfactant together with a quaternary ammonium salt surfactant. The process consists of spraying the product onto a fabric to dampen it. Church, U.S. Pat. No. 4,806,254 discloses an aqueous composition for removing wrinkles containing a monohydric alcohol, glycerine, a nonionic surfactant, and dimethyl siloxane.

A composition for fabric wrinkle reduction and shape retention is disclosed in Coffindaffer, U.S. Pat. No. 4,923,623, which includes a liquid starch having curable amino functional silicones. A fabric wrinkle reduction composition and method is disclosed by Agbomeirele et al., U.S. Pat. No. 5,100,566 ("'566 patent"), which contains an aqueous-alcoholic solution of an anionic siliconate and glycerine. The '566 patent also discloses a method for applying such a composition onto a fabric. Vogel et al., U.S. Pat. Nos. 5,532,023 and 5,798,107 disclose the use of an aqueous spray for reducing wrinkles on treated fabric using compositions containing an effective amount of non-volatile silicone fluids, such as polydimethyl siloxane gums and amino silicones together with an effective amount of film-forming polymers.

All of the patents set forth above disclose wrinkle abatement compositions and processes. All of these patents, however, are unsatisfactory for meeting the need for wrinkle abatement, long-lasting fragrance, and malodor control in a single, easy-to-use composition.

An approach to reducing malodors on fabrics is disclosed in Trinh et al., U.S. Pat. No. 6,001,343, which includes an uncomplexed cyclodextrin in an aqueous system, a fragrance wherein at least 80% by weight of the fragrance components have a ClogP of less than 3.5, and cyclodextrin-compatible fiber lubricants such as polydimethyl siloxanes which are hydrophobic and shape retention polymers, lithium salt or mixtures thereof for odor and wrinkle control. This patent, however, suffers from the drawback that it does not provide a long lasting fragrance.

While the approaches set forth above are designed to control odors or reduce wrinkles, none of them addresses the problem of maintaining a fresh smell and combating environmental odors during use. Accordingly, a need exists for a composition that provides a long-lasting fragrance that will provide a fresh clean smell, counteract malodors, and reduce wrinkles without the need to iron.

SUMMARY OF THE INVENTION

One embodiment of the invention is a fabric refreshing composition. This composition includes:

(a) a water soluble silicone of the formula I:

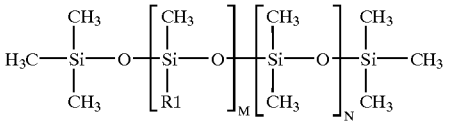

wherein

M is 40 to 200,

N is 0 to 20, and

R1 is a polyethylene or a polypropylene ether;

(b) a fragrance composition; and (c) an aqueous carrier containing an emulsifier.

Another embodiment of the invention is a process for refreshing a fabric. This process includes applying to a fabric a sufficient amount of a fabric refreshing composition to dampen the fabric, wherein the composition includes:

(i) a water soluble silicone of the formula I:

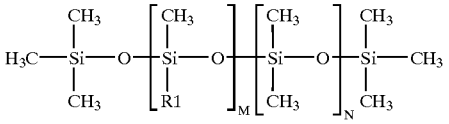

wherein

M is 40 to 200,

N is 0 to 20, and

R1 is a polyethylene or a polypropylene ether;

(ii) a fragrance composition; and (iii) an aqueous carrier containing an emulsifier. While the fabric is still damp, a wrinkle-removing force is then applied to the fabric, which force is sufficient to substantially remove the wrinkles from the fabric.

DETAILED DESCRIPTION OF THE INVENTION

We have surprisingly found that a long-lasting scent may be imparted to a fabric by spraying the fabric with a fabric refreshing composition containing a water-soluble silicone, a fragrance, and an aqueous carrier. We have also found that such a composition also provides wrinkle-reduction.

As used herein, the terms "wrinkle-reduction," "de-wrinkling," and "wrinkle abatement" are used interchangeably, and refer to the ability of the present process, and compositions to remove wrinkles from a fabric.

As used herein, the term "malodor control" refers to the ability of the present process and compositions to reduce any malodor that a fabric has picked up and to help reduce the perception of malodor when the fabric is subsequently exposed to a malodor.

In the present invention, the term "fabric" means articles of clothing or other household materials (sheets, towels, blankets, etc.). In the present invention, "fabric" includes synthetic, natural, nylon, acrylic, and blended articles. For example, a fabric may include materials made from cotton, linen, polyester, rayon, and blends thereof.

Thus, in the present invention, "fabric refreshing" or a fabric refreshing composition refers to a single composition that imparts a fragrance, malodor control, and wrinkle abatement to a fabric.

In the present invention the water-soluble silicone is a dimethicone copolyol, which is a polymer of dimethyl siloxane with polyoxyethylene and/or polyoxypropylene side chains having the structure of formula I:

I

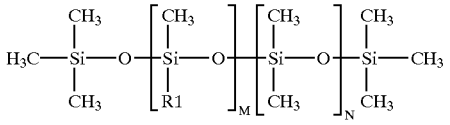

wherein

M is 40 to 200;

N is 0 to 20; and

R1 is a polyethylene or a polypropylene ether.

The water-soluble silicone is present in the composition in an amount that is at least 0.1%(wt), preferably at least 0.4%(wt). The water-soluble silicone may contain at least one, preferably at least two dimethicone copolyols.

The dimethicone copolyol is one that is water-soluble, and has a surface activity that enables it to wet and penetrate the fiber. The preferred polymer is one that has an ethylene oxide to propylene oxide ratio ("EO/PO") greater than 20/80, preferably greater than 40/60, and a surface tension in a 0.1% solution in water at 25° C. of less than 25 mN/m. Examples of dimethicone copolyols that may be used in the present invention include the TEGOPREN® nonionic series marketed by Goldschmidt Corporation (Hopewell, Va.).

The fragrance composition in the fabric refreshing composition may be a perfume oil consisting of a mixture of one or more of the following classes of compounds: alcohols, aldehydes, ketones, esters, acetals, oximes, nitrites, ethers, and essential oils. Preferably, the fragrance composition contains at least 75% of an aroma chemical with a vapor pressure at 25° C. below 5,000 micrograms per liter, preferably below 2,000 micrograms per liter. Preferably, the aroma chemical will have a low perception threshold.

In an alternative embodiment, the fabric refreshing compositions may contain a fragrance composition wherein greater than 50%(wt) of the components therein have a vapor pressure of less than 5,000 microgram per liter at 25° C.

The aqueous carrier contains water and an emulsifier. The carrier may optionally contain low molecular weight monohydric alcohols that are highly water soluble, for example C1–C4 alcohols such as methyl alcohol, ethyl alcohol, propyl alcohol, and isopropyl alcohol and mixtures thereof, and low molecular weight polyhydric alcohols, for example C2–C6 alcohols such as ethylene glycol, polyalkylene glycols, etc., and mixtures thereof. The water is preferably demineralized water.

The aqueous carrier is typically greater than 80%(wt) of the composition, preferably greater than 90%(wt) of the composition. The aqueous carrier may contain optional ingredients such as wetting agents, antimicrobial agents, sequesterants, UV absorbers, water-soluble dyes, optical brighteners, fiber lubricants, fiber relaxants, antistatic agents, chelating agents, soil release polymers, and mixtures thereof.

As set forth above, wetting agents may be present in the aqueous carrier. Such agents help the soluble silicones to penetrate the fibers of a treated fabric and do not produce copious foam, especially when applied by a spray. Examples of suitable wetting agents that may be used in the present invention include fluorosurfactants, such as ZONYL® fluorosurfactants from E.I. du Pont de Nemours and Company, (Wilmington, Del.), or alkyl glucosides such as the BEROL® series from Akzo Nobel (Stenungsund, Sweden). Mixtures of such wetting agents may also be used.

The fiber relaxant/lubricant agents of the present invention may be natural or synthetic polymers. These polymers may include, for example, cationic polyglycolethers, silicon microemulsions, quaternized polymethysiloxanes, polycarboxylic acids, polyvinylpyrrolidone/dimethylaminoethyl methacrylate copolymers, and mixtures thereof.

Antimicrobial agents may be incorporated into the present compositions. Such antimicrobial agents include, for example, metal salts such as zinc citrate, zinc oxide, zinc pyrethiones, and octopirox; organic acids, such as sorbic acid, benzoic acid, and their salts; parabens, such as methyl paraben, propyl paraben, butyl paraben, ethyl paraben, isopropyl paraben, isobutyl paraben, benzyl paraben, and their salts; alcohols, such as benzyl alcohol, phenyl ethyl alcohol; boric acid; 2,4,4'-trichloro-2-hydroxy-diphenyl ether; phenolic compounds, such as phenol, 2-methyl phenol, 4-ethyl phenol; essential oils such as rosemary, thyme, lavender, eugenol, geranium, tea tree, clove, lemon grass, peppermint, or their active components such as anethole, thymol, eucalyptol, famesol, menthol, limonene, methyl salicylate, salicylic acid, terpineol, nerolidol, geraniol, and mixtures thereof.

Examples of the chelating agents that may be incorporated into the aqueous carrier include, for example, sodium tripolyphosphate, sodium acid pyrophosphate, tetrasodium pyrophosphate, aminopolycarboxylates such as nitlilotriacetic acid and ethylenediamine tetracetic acid and salts thereof, and polyphosphonates and aminopolyphosphonates such as hydroxyethanediphosphonic acid, ethylenediamine tetramethylenephosphonic acid, diethylenetriaminepentamethylenephosphonic acid and salts thereof. The chelating agent selected is not critical except that it must be compatible with the other components in the composition.

The emulsifier in the aqueous carrier is used to solubilize components in the fabric refreshing composition, such as the fragrances. The emulsifier may be selected from anionic, amphoteric, and nonionic surfactants and mixtures thereof. The criteria for selecting the emulsifier or mixture of emulsifiers is/are that the emulsifier produces a transparent or translucent solution that is stable. The level and type of emulsifier should not produce significant foaming on spraying or leave a sticky residue on the treated fabrics. Typically, the level of emulsifier will be greater than 0.05%(wt), such as for example, between 0.05%(wt) to about 3%(wt), preferably from about 0.1%(wt) to about 1%(wt).

Non-ionic surfactants are preferably used as the emulsifier in the present invention. Nonionic surfactants are compounds produced by the condensation of alkylene oxide groups with an organic hydrophobic material, which may be aliphatic, or alkyl aromatic in nature. The length of the hydrophilic or polyoxyalkylene radical that is condensed with any particular hydrophobic group may be readily adjusted to yield a water-soluble compound having the desired degree of balance between hydrophilic and hydrophobic elements.

Examples of various nonionic surfactant types suitable for use in the present invention include: a) polyoxyethylene or polyoxypropylene condensates of aliphatic carboxylic acids, whether linear or branched-chain and saturated or unsaturated, containing from about 8 to about 18 carbon atoms in the aliphatic chain and incorporating from about 5 to about 50 ethylene oxide and/or propylene oxide units. Suitable carboxylic acids include "coconut" fatty acids which contain an average of about 12 carbon atoms, "tallow" fatty acids which contain an average of about 18 carbon atoms, palmitic acid, myristic acid, stearic acid, and lactic acid; (b) polyoxyethylene or polyoxypropylene condensates of aliphatic alcohols, whether linear or branched-chain and saturated or unsaturated, containing from about 6 to about 24 carbon atoms and incorporating from about 5 to about 50 ethylene oxide and/or propylene oxide units. Suitable alcohols include "coconut" fatty alcohol, "tallow" fatty alcohol, lauryl alcohol, myristyl alcohol and oleyl alcohol. Examples of such compounds include CREMOPHOR® RH 40 and CREMOPHOR® RH-60 and mixtures thereof, which are hydrogenated ethoxylated castor oil marketed by BASF Corporation (Mount Olive, N.J.); and (c) polyoxyethylene or polyoxypropylene condensates of alkyl phenols. These compounds include the condensation products of alkyl phenols having an alkyl group containing from about 6 to 12 carbon atoms in either a straight chain or branched configuration with ethylene and/or propylene oxide, the ethylene and/or propylene oxide being present at about 5 to 25 moles of ethylene and/or propylene oxide per mole of alkyl phenol. The alkyl substituent in such compounds may be derived, for example, from polymerized propylene, diisobutylene, and the like. Examples of compounds of this type include nonyl phenol condensed with about 9.5 moles of ethylene oxide per mole of phenol; dinonyl phenol condensed with about 12 moles of ethylene oxide per mole of phenol; dinonyl phenol condensed with about 15 moles of ethylene oxide per mole of phenol; and diisooctyl phenol condensed with about 15 moles of ethylene oxide per mole of phenol. Commercially available nonionic surfactants of this type include IGEPAL CO-630®, marketed by the GAF Corporation (Wayne, N.J.), and TRITON® X-45, X-114, X-100, and X-102, all marketed by the Rohm and Haas Company (Philadelphia, Pa.). Preferred nonionic surfactants in this category include water-soluble surfactants sold by the Rohm and Haas Company under the trademark TRITON®. An example of a preferred TRITON® surfactant is TRITON® X-100, which is an octylphenoxypolyethoxyethanol containing an average of 10 moles of ethylene oxide. Other surfactants that are also classed as nonionic include, for example, anhydrohexitol derivatives, sugar esters, fatty alkanolamides, and fatty amine oxides.

Other examples of hydrogenated castor oil that may be used in the present compositions include Isoceteth-20 (ARLASOLVE® 200L) or a mixture of PPG-26 -Buteth-26 and PEG-40 hydrogenated castor oil (SOLUBILISATANT LRI™ marketed by Warner Jenkinson Company, Inc., South Plainfield, N.J.).

Another embodiment of the invention is a process for refreshing a fabric. This process includes applying to a fabric a sufficient amount of a fabric refreshing composition, as defined above, to dampen the fabric, and while the fabric is damp, applying a wrinkle-removing force to the fabric sufficient to substantially remove the wrinkles from the fabric. One skilled in the art is readily able to determine how much of the fabric refreshing composition to apply to dampen the fabric. The amount will vary depending on the type of fabric to be refreshed, the surface area of the fabric, and other well-known variables.

As used herein, a "wrinkle removing force" means a force that is placed on the fabric that is insufficient to damage the fabric but that places sufficient stress on it to straighten the fabric so as to substantially remove wrinkles from it. The wrinkle removing force may be applied to the fabric using any convenient means. For example, the force may be applied manually by fixing one end of the fabric and manually pulling on the opposite end until the fabric is straight.

The amount of time that the force must be maintained to substantially remove the wrinkles from the fabric will vary depending on the fabric, degree of wrinkle, and other well-known variables. This time period is easily determined by one skilled in the art or it may be easily determined empirically by a consumer.

As used herein, the phrase "substantially remove the wrinkles from the fabric" means that after the wrinkle-removing force is applied, the fabric is sufficiently wrinkle-free that a typical consumer would consider it as such, and would wear or use the treated fabric. For purposes of the present invention, the wrinkles in a fabric are "substantially removed" when the %wrinkle reduction as defined and measured in Example 4 is at least 40%, preferably greater than 45% compared to the fabric before treatment using the process of the invention.

In this process, the compositions of the present invention may be applied to fabrics using any conventional means so long as a sufficient amount of the composition is deposited onto the surface of the fabric to be refreshed. For example, the composition may be sprayed onto the fabric to be refreshed. Accordingly, the composition may be used in an aerosol spray dispenser, a self-pressurized non-aerosol spray dispenser, a pump-spray dispenser, or a trigger-spray dispenser. The compositions may also be atomized and then dispensed onto a surface of a fabric. The compositions may also be poured onto a surface of the fabric to be refreshed and manually worked in.

The following Examples are provided to further illustrate the compositions, and processes in accordance with the invention. These examples are illustrative only and are not intended to limit the scope of the invention in any way. In these examples, all % are %(wt), unless otherwise noted.

EXAMPLES

Unless otherwise indicated, all % values in the examples are %(wt).

Example 1

The effect of the dimethicone copolyols on fragrance duration was determined using a fragrance containing the following components:

TABLE 1

| | % | ClogP |
|---|---|---|
| Benzyl Alcohol | 10 | 1.0 |
| Benzyl Acetate | 10 | 1.9 |
| Methyl Salicylate | 10 | 2.2 |
| Phenylethyl Acetate | 10 | 2.3 |
| Dimethyl Benzyl Carbinyl Acetate | 10 | 3.0 |
| Florhydral | 10 | 3.7 |
| Limonene | 10 | 4.6 |
| Hexyl Salicylate | 10 | 4.6 |
| Hexyl Cinnamic Aldehyde | 10 | 5.3 |
| FIXOLIDE ® | 10 | 6.4 |

FIXOLIDE ® is 7-acetyl,1,1,3,4,4,6-hexamethyltetraline

The fragrance as set forth in Table 1 was then incorporated into the formulations as set forth in Table 2.

TABLE 2

| | RS21-170A | RS21-194A | RE21-194B | RS21-194C |
|---|---|---|---|---|
| Deionized Water | 92.5 | 92.5 | 92.5 | 93.3 |
| Isopropanol | 5.8 | 5.8 | 5.8 | 5.8 |
| BEROL ® | 0.2 | 0.2 | 0.2 | 0.2 |
| ZONYL ® | 0.1 | 0.1 | 0.1 | 0.1 |
| TEGOPREN ® 5840 | 0.4 | 0.8 | — | — |
| TEGOPREN ® 5847 | 0.4 | — | 0.8 | — |
| CREMOPHOR ® H60 | 0.3 | 0.3 | 0.3 | 0.3 |
| CREMOPHOR ® H40 | 0.05 | 0.05 | 0.05 | 0.05 |
| Fragrance | 0.25 | 0.25 | 0.25 | 0.25 |

BEROL ® AG6202 is an alkyl glucoside available from Akzo-Nobel
ZONYL ® FSO is a nonionic fluorosurfactant available from E. I. di Pont de Nemours and Co.
TEGOPREN ® 5840 is a dimethicone copolyol available from Goldschmidt Chem. Corp.
TEGOPREN ® 5847 is a dimethicone copolyol available from Goldschmidt Chem. Corp.
CREMOPHOR ® H60, H40 are ethoxy hydrogenated castor oils.

Twenty-five grams of each formulation as set forth in Table 2 was sprayed separately onto individual 12 inch ×12 inch Terry toweling swatches (i.e., one formulation per swatch). The Terry toweling swatches were air dried for 6 hours, and then placed in a headspace jar. Samples were equilibrated for 2 hours then a 2-liter headspace sample was taken. Headspace samples were analyzed by thermal desorption (ATD 400) and GC/MS, and the results are presented in Table 3 below.

TABLE 3

| Formulation | Ng/Liter |
|---|---|
| RS21-170A | 594.4 |
| RS21-194A | 701.7 |
| RS21-194B | 560.0 |
| RS21-194C | 486.5 |

As the data indicate, the formulations containing a single dewrinkling polymer (RS21-94A and B) and a combination of dewrinkling polymers (RS21-170A) resulted in significantly better fragrance retention compared to the formulation containing no dewrinkling polymers (RS21-194C).

Example 2

Formulations RS21-170A and RS21-194C (dewrinkler formulations) using the fragrance defined in Table 1 were evaluated as follows:

Swatches of cotton dress shirt and cotton terry toweling were dosed with equal amounts of the respective dewrinkler formulations (one formulation per swatch as indicated in Table 4). The fabric swatches were allowed to dry overnight. 2 liters of Headspace were collected from each sample, and analyzed as set forth in Example 1. The results are shown in Table 4.

TABLE 4

| | Headspace Summary (Ng/L) | |
|---|---|---|
| Fabric | RS21-170A | RS21-194C |
| Cotton Dress Shirt | 6.67 | 1.24 |
| Terry Toweling | 18.26 | 3.79 |

As the data indicate, the fragrance from the formulation containing a combination of dewrinkling polymers (RS21-170A) was retained on the evaluated fabrics significantly longer than the fragrance in the formulation containing no dewrinkling polymer (RS21-194C).

Example 3

Dimethicone copolyols were tested against water for their wrinkle reducing effectiveness.

The following aqueous solutions were made by mixing the components at room temperature, and then evaluated as set forth in more detail below.

A. 0.1% Tegopren 5840+0.1% Tegopren 5847

B. 0.2% Tegopren 5840+0.1% Tegopren 5847

C. 0.4% Tegopren 5840+0.4% Tegopren 5847

D. 0.5% Tegopren 6922

E. 1.0% Tegopren 6922

White polyester cotton (65/35) was cut into 15 inch×15 inch swatches. These were folded and pulled into a tube (15 mm in diameter) to create creases. Each swatch was left for 10 minutes and removed.

Digital photographs were taken of each creased swatch under a strong tungsten light.

The fabric swatches were hung up and sprayed with the respective solutions as follows: 3 sprays across the top, 3 sprays across the middle, and 3 sprays along the bottom. This applied a total of approximately 2.0 grams of solution to each fabric swatch. The fabric was left for 30 minutes to allow the moisture to spread evenly. The fabric swatches were wiped by hand in a downward direction, once on the left side, once on the right side, and once in the middle, this was repeated. The fabric swatches were then left to dry for 1 hour.

Digital photographs were taken as above. The photographs were then transferred onto a computer with Photowise Image Acquisition Management software (AGFA), Version 1.5.2.

Image analysis was performed using the Adobe Photoshop version 4.0 software package. A standard area (500×500 pixels) of the image was analyzed each time. The image was set to gray scale so that each pixel selected in the defined area can be scored on a white to black scale. The mean and standard deviation were calculated for the untreated creased test piece and the treated test piece. A histogram of the grayness score was produced The lower the standard deviation from the mean value, the lower the degree of creasing. The % Wrinkle reduction was, therefore, calculated from the standard deviations using the following equation:

$$(SD\ \text{Initial} - SD\ \text{after})/SD\ \text{Initial} \times 100.$$

The data are presented in Table 5.

TABLE 5

| Treatment | Before Mean | Before SD | After Mean | After SD | % Wrinkle Reduction |
|---|---|---|---|---|---|
| Water | 209.1 | 14.7 | 219.7 | 9.1 | 38 |
| A | 205.1 | 12.3 | 227.5 | 7.5 | 39 |
| B | 203.3 | 14.4 | 216.1 | 7.4 | 48 |
| C | 204.0 | 16.05 | 226.5 | 6.8 | 57.6 |
| D | 202.0 | 13.5 | 216.7 | 7.8 | 40.0 |
| E | 202 | 13.4 | 221.5 | 7.7 | 42.7 |

A %wrinkle reduction of at least 40%, preferably greater than 45%, was determined to substantially remove wrinkles from the fabric.

Example 4

Formulations RS21-170A, RS21-194C as disclosed in Example 2 were compared for wrinkle reduction.

Cotton sheeting test pieces were twisted and held with an elastic band for 1 hour to produce creasing. They were removed and suspended on a line. The spray dispenser was held with the nozzle upright at approximately 4–6 inches from the fabric and the wrinkled area was pulled taut. Approximately 2 g of each formulation were sprayed onto one half of the fabric in a circular motion. After 10 seconds the fabric was pulled taut and smoothed with a tissue. The test pieces were hung to dry.

A 5-point scale was used to rate the product's performance.

Fifteen independent panelists performed the evaluation of the fabric. Each panelist was asked to rate the effect of each de-wrinkler formulation on a scale of 0–4, as shown below.

Scale:

0 Poor Dewrinkling Effect

1 Fair Dewrinkling Effect

2 Moderate Dewrinkling Effect

3 Very Good Dewrinkling Effect

4 Excellent Dewrinkling Effect

The panel results are as follows:

| | |
|---|---|
| RS21-170A | 3.3 |
| Water | 2.8 |
| DOWNY ® | 2.7 |

As the data show, the inventive formulation (RS21-170A) outperformed both water and a commercially available dewrinkling formulation (DOWNY®, available from Procter & Gamble Co., Cincinnati, Ohio).

Example 5

Several 200-gram samples of the fabric refreshing formulations according to the present invention were made as set forth in Table 6 shown below. A 50-gram sample of each formulation was placed in a Nessler tube, which was placed on a black cardboard square. The clarity of each formulation was assessed (See Table 6) using the scale below by looking down the tube.

Clarity:

1=opaque

2=nearly opaque

3=nearly clear

4=Crystal Clear

To assess the foaming property of each formulation, 100-gram of each formulation was placed in a small trigger spray device. The sample was sprayed three times onto a black piece of cotton sheeting and the foaming of each formulation was assessed (See Table 6) using the scale below:

Foam:

1=No Foam

2=Slight Foam

3=Moderate Foam

4=High Foam

TABLE 6

| | RS-21-214A | RS21-214B | RS21-214C | RS21-214D | RS21-214E | RS21-214F |
|---|---|---|---|---|---|---|
| Deionized water | 92.5 | 92.6 | 92.6 | 92.6 | 93.4 | 92.3 |
| Isopropanol | 5.8 | 5.8 | 5.8 | 5.8 | 5.8 | 5.8 |
| BEROL ® | — | — | — | — | — | 0.2 |
| ZONYL ® FSO | 0.1 | — | — | — | — | 0.1 |
| TEGOPREN ® 5840 | 0.4 | 0.4 | 0.8 | — | — | 0.4 |
| TEGOPREN ® 5847 | 0.4 | 0.4 | — | 0.8 | — | 0.4 |
| CREMOPHOR ® RH60 | 0.3 | 0.3 | 0.3 | 0.3 | 0.3 | 0.3 |
| CREMOPHOR ® RH40 | 0.05 | 0.05 | 0.05 | 0.05 | 0.05 | 0.05 |
| PLANTAREN ® 2000* | 0.2 | 0.2 | 0.2 | 0.2 | 0.2 | |
| SUPRALATE ® C** | — | — | — | — | — | 0.2 |
| Fragrance | 0.25 | 0.25 | 0.25 | 0.25 | 0.25 | 0.25 |
| CLARITY | 4 | 4 | 4 | 4 | 4 | 4 |
| FOAM | 2b | 2 | 2 | 2 | 1.5 | 2.5 |

*PLANTAREN ® 2000N is an alkyl C8–10 glucoside made by Henkel, Dusseldorf, Germany.
**SUPRALATE ® C is sodium lauryl sulphate made by Witco, Memphis, Tennessee.

As the data in Table 6 indicate, all of the formulations according to the present invention provided excellent clarity and only slight foaming when applied to the test fabric.

Example 6

To evaluate the reduction in malodor that an inventive formulation according to the present invention can achieve on a fabric, two inventive formulations were tested on Terry toweling and cotton sheets exposed to smoke. The % Malodor Reduction, in this case, the % Smoke Reduction, was measured according to the following formula:

% Malodor Reduction=((Mean Malodor Score−Mean Test Product Malodor Score)/Control Malodor Score)×100.

Three swatches each of clean cotton sheeting (12×12 inch) and Terry toweling (12×12 inch) were made. Two swatches of each fabric were used as experimental, and one swatch of each fabric was reserved as a control. All the swatches were treated with smoke by placing them in a cigarette smoke filled environment for 10 minutes. 25-gram or 5-gram of each formulation was sprayed individually onto one of the Terry toweling or cotton sheeting swatches, respectively. No formulation was sprayed onto the two control swatches. All the swatches were left to line-dry for 1 hour and evaluated by a panel of 10 for cigarette smoke odor intensity. The swatches were also assessed for smoke odor intensity and the % reduction in cigarette smoke odor calculated. The results are presented in Table 7.

TABLE 7

| Formulation | Toweling (% Reduction of Smoke Odor) | Cotton Sheet (% Reduction of Smoke Odor) |
|---|---|---|
| RS21-194A | 56.9 | 56.5 |
| RS21-194C | 45.6 | 46.4 |

As the data in Table 7 indicate, the inventive formulations significantly reduced smoke odor in the respective swatches (toweling and cotton sheet). These data indicate that a satisfactory malodor reduction is achievable using one of the inventive formulations. Preferably the malodor reduction used in the present fabric refreshing compositions will reduce the subject malodor by at least 45%, preferably greater than 56%.

The invention being thus described, it will be obvious that the same may be varied in many ways. Such variations are not to be regarded as a departure from the spirit and scope of the invention and all such modifications are intended to be included within the scope of the following claims.

What is claimed is:

1. A fabric refreshing composition comprising:

(a) a water soluble silicone of the formula I:

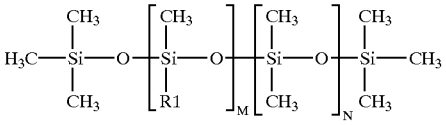

wherein

M is 40 to 200,

N is 0 to 20, and

R1 is a polyethylene or a polypropylene ether;

(b) a fragrance composition; and (c) an aqueous carrier comprising an emulsifier.

2. A composition according to claim 1 wherein the water-soluble silicone is a polymer or mixture of polymers of dimethyl siloxane with polyoxyethylene and polyoxypropylene side chains.

3. A composition according to claim 1 wherein the water soluble silicone is present in the composition in an amount that is at least 0.1%(wt).

4. A composition according to claim 3 wherein the water soluble silicone is present in the composition in an amount that is at least 0.4%(wt).

5. A composition according to claim 1 wherein the water-soluble silicone is a dimethicone copolyol.

6. A composition according to claim 1 wherein the water-soluble silicone comprises at least two dimethicone copolyols.

7. A composition according to claim 5 wherein the dimethicone copolyol, when in a 0.1%(wt) aqueous solution, has a surface tension of less than 25 mN/m.

8. A composition according to claim 5 wherein the dimethicone copolyol has an EO/PO ratio greater than 20:80.

9. A composition according to claim 8 wherein the dimethicone copolyol has an EO/PO ratio greater than 40:60.

10. A composition according to claim 1 wherein the fragrance composition comprises fragrance components selected from the group consisting of alcohols, aldehydes, ketones, esters, acetals, oximes, nitrites, ethers, essential oils, and mixtures thereof.

11. A composition according to claim 1 wherein the fragrance composition contains at least 75%(wt) of an aroma chemical with a vapor pressure at 25° C. below 5,000 microgram per liter.

12. A composition according to claim 11 wherein the fragrance composition contains at least 75%(wt) of an aroma chemical with a vapor pressure at 25° C. below 2,000 microgram per liter.

13. A composition according to claim 1 wherein greater than 50% of the components in the fragrance composition have a vapor pressure of less than 5,000 microgram per liter.

14. A composition according to claim 1 wherein the emulsifier is present in the composition at greater than 0.05%(wt).

15. A composition according to claim 1 wherein the emulsifier is selected from the group consisting of an anionic, an amphoteric surfactant, a nonionic surfactant, and mixtures thereof.

16. A composition according to claim 15 wherein the nonionic surfactant is produced by the condensation of alkylene oxide groups with an aliphatic or alkyl aromatic hydrophobic compound.

17. A composition according to claim 16 wherein the nonionic surfactant is octylphenoxypolyethoxy ethanol.

18. A composition according to claim 16 wherein the nonionic surfactant is hydrogenated castor oil.

19. A composition according to claim 16 wherein the nonionic surfactant is Isoceteth-20.

20. A composition according to claim 16 wherein the nonionic surfactant is a mixture of PPG-26-Buteth-26 and PEG-40 hydrogenated castor oil.

21. A composition according to claim 1 wherein the aqueous carrier comprises a C1–C4 monohydric alcohol or a C2–C6 polyhydric alcohol.

22. A composition according to claim 21 wherein the C1–C4 alcohol is selected from the group consisting of methyl alcohol, ethyl alcohol, propyl alcohol, isopropyl alcohol, and mixtures thereof.

23. A composition according to claim 21 wherein the C2–C6 alcohol is selected from the group consisting of ethylene glycol, polyalkylene glycols, and mixtures thereof.

24. A composition according to claim 1 wherein the aqueous carrier is deionized water.

25. A composition according to claim 1 wherein the composition comprises greater than about 80% (wt) water.

26. A composition according to claim 25 wherein the composition comprises greater than about 90% (wt) water.

27. A composition according to claim 1 wherein the aqueous carrier further comprises a composition selected from the group consisting of wetting agents, antimicrobial agents, sequesterants, UV absorbers, water-soluble dyes, optical brighteners, fiber lubricants, fiber relaxants, antistatic agents, chelating agents, soil release polymers, and mixtures thereof.

28. A composition according to claim 27 wherein the wetting agent is selected from the group consisting of fluorosurfactants, alkyl glucosides, and mixtures thereof.

29. A process for refreshing a fabric comprising:

(a) applying to a fabric a sufficient amount of a fabric refreshing composition to dampen the fabric, wherein the composition comprises:

(i) a water soluble silicone of the formula I:

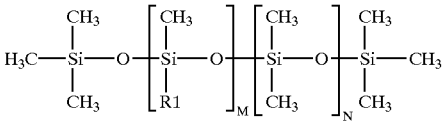

wherein

M is 40 to 200,

N is 0 to 20, and

R1 is a polyethylene or a polypropylene ether;

(ii) a fragrance composition; and (iii) an aqueous carrier comprising an emulsifier;

(b) applying a wrinkle-removing force to the fabric while it is still damp, which force is sufficient to substantially remove the wrinkles from the fabric.

30. A process according to claim 29 wherein step (a) comprises spraying the composition onto a surface of the fabric.

31. A process according to claim 30 wherein the composition is sprayed onto a surface of the fabric with a dispenser selected from the group consisting of an aerosol spray dispenser, a self-pressurized non-aerosol spray dispenser, a pump-spray dispenser, and a trigger-spray dispenser.

* * * * *